US008210312B1

(12) United States Patent
Tetreault, Jr.

(10) Patent No.: US 8,210,312 B1
(45) Date of Patent: Jul. 3, 2012

(54) MOBILE WORK PLATFORM

(76) Inventor: Adrien R. Tetreault, Jr., South Glastonbury, CT (US)

( * ) Notice: Subject to any disclaimer, the term of this patent is extended or adjusted under 35 U.S.C. 154(b) by 405 days.

(21) Appl. No.: 12/491,471

(22) Filed: Jun. 25, 2009

(51) Int. Cl.
*E06C 7/16* (2006.01)

(52) U.S. Cl. ..... 182/119; 182/118; 182/152

(58) Field of Classification Search ..... 182/129, 182/115–119, 152–155, 222, 223
See application file for complete search history.

(56) References Cited

U.S. PATENT DOCUMENTS

| | | | | | |
|---|---|---|---|---|---|
| 561,263 | A | * | 6/1896 | Lucas | 182/119 |
| 812,091 | A | * | 2/1906 | Rose | 182/123 |
| 870,680 | A | * | 11/1907 | Karges | 108/1 |
| 2,394,221 | A | * | 2/1946 | Waltz | 182/152 |
| 2,656,223 | A | * | 10/1953 | Gray | 182/119 |
| 2,665,951 | A | * | 1/1954 | Bobst | 182/180.1 |
| 3,093,209 | A | * | 6/1963 | Nagy | 182/118 |
| 3,105,572 | A | * | 10/1963 | Nesslinger et al. | 182/152 |
| 3,241,633 | A | * | 3/1966 | Bond et al. | 182/28 |
| 3,250,344 | A | * | 5/1966 | Romano | 182/27 |
| 3,446,309 | A | * | 5/1969 | Davis et al. | 182/129 |
| 3,463,265 | A | * | 8/1969 | Clover | 182/17 |
| 3,788,424 | A | * | 1/1974 | Chabot | 182/129 |
| 4,083,427 | A | * | 4/1978 | Box | 182/118 |
| 4,253,548 | A | * | 3/1981 | Beeche | 182/142 |
| D265,425 | S | | 7/1982 | Graas | |
| 4,534,447 | A | * | 8/1985 | Champigny | 182/152 |
| 4,576,251 | A | * | 3/1986 | Matsuura et al. | 182/152 |
| 4,793,624 | A | | 12/1988 | Mace | |
| 4,807,719 | A | * | 2/1989 | Burkstrand et al. | 182/15 |
| 5,086,875 | A | * | 2/1992 | Shreve, III | 182/152 |
| 5,505,413 | A | | 4/1996 | Hennessey | |
| 5,555,954 | A | * | 9/1996 | Swiderski | 182/152 |
| 5,622,463 | A | * | 4/1997 | Testa | 409/131 |
| 5,678,653 | A | * | 10/1997 | Clinch | 182/119 |
| D486,243 | S | * | 2/2004 | Yamaoka | D25/66 |
| 6,776,259 | B1 | * | 8/2004 | Murten | 182/3 |
| 6,863,155 | B2 | * | 3/2005 | Wyse et al. | 182/118 |
| 6,929,093 | B1 | * | 8/2005 | Land | 182/13 |
| 7,210,558 | B2 | * | 5/2007 | Eaves | 182/115 |
| 2004/0094362 | A1 | * | 5/2004 | Wyse | 182/119 |
| 2005/0034922 | A1 | * | 2/2005 | Wyse | 182/119 |
| 2005/0103569 | A1 | * | 5/2005 | Winter | 182/223 |
| 2007/0033882 | A1 | | 2/2007 | Bessent | |
| 2008/0000722 | A1 | * | 1/2008 | Winslow et al. | 182/129 |
| 2009/0218166 | A1 | * | 9/2009 | Newton | 182/129 |
| 2010/0071994 | A1 | * | 3/2010 | Tseng | 182/27 |

* cited by examiner

*Primary Examiner* — Katherine W Mitchell
*Assistant Examiner* — Johnnie A Shablack
(74) *Attorney, Agent, or Firm* — Kyle Fletcher

(57) ABSTRACT

The mobile work platform is a collapsible frame assembly that can support tools, supplies, and workers. The collapsible frame involves two distinct embodiments wherein a first embodiment involves a frame assembly that simply folds flat when not in use, and a second embodiment involves a rotating ladder assembly in conjunction with a frame assembly that can fold flat when not in use. Both embodiments include ladder rungs upon each side to enable climbing upon said device as well as removable scaffolds.

15 Claims, 13 Drawing Sheets

MOBILE WORK PLATFORM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of a tool and supply rack, more specifically, a tool and supply rack that is both collapsible, lightweight, and mobile.

B. Discussion of the Prior Art

The Bessent Patent Application Publication (U.S. Pub. No. 2007/0033882) discloses a clean work booth comprising lockable wheels, a ladder mounted between upper and floor portions of the frame that is made of metal tubes. However, the work booth of the Bessent application does not collapse for ease of lifting the device.

The Clinch Patent (U.S. Pat. No. 5,678,653) discloses a wallboard hanging scaffolding system comprising trapezoidal-shaped upstanding side members with wheels, a horizontal rigid section forming a platform, and a plurality of ladders within members of the Clinch Patent does not include a plurality of removable shelves for holding tools and/or supplies, and is directed to scaffolding.

The Box Patent (U.S. Pat. No. 4,083,427) discloses a ladder scaffold comprising a pair of upright ladders, a pair of wheels mounted on the bottom of the ladders, and a platform plank resting on rungs of the ladder. However, the ladder scaffold of the Box Patent does not include a plurality of removable shelves for use in holding tools and or supplies, nor does the ladder scaffold collapse down by folding the two "A" frame members onto the support frame.

The Hennessey Patent (U.S. Pat. No. 5,505,413) discloses an A-frame instrument stand comprising pivotable leg members for movement between a collapsed position and erected position, and made of square metal stock. However, the A-frame instrument stand of the Hennessey Patent does not include a plurality of removable shelves for supporting tools and/or supplies. Furthermore, the A-frame instrument stand does not include a plurality of caster wheels.

The Mace Patent (U.S. Pat. No. 4,793,624) discloses a multiple-use cart comprising a vertical support for transporting planar materials, rotatably mounted wheels, and made of steel channel members. However, the multiple-use cart of the Mace Patent does not have a plurality of horizontally, removable shelves for transporting tools and/or supplies. Furthermore, the multiple-use cart does not collapse flat when not in use.

The Yamaoka Patent (U.S. Pat. No. Des. 486,243) illustrates a design for a footing platform assembly for working. However, the footing platform does not depict a plurality of removable shelves that attach to a collapsible frame.

The Graas Patent (U.S. Pat. No. Des. 265,425) illustrates a design for a collapsible mobile work platform, which does not depict a plurality of removable shelves, in conjunction with a fully mobile platform that does not require lifting.

While the above-described devices fulfill their respective and particular objects and requirements, they do not describe a mobile work platform that can carry tools, supplies, and people, and of which is collapsible. In this regard, the mobile work platform departs from the conventional concepts and designs of the prior art.

SUMMARY OF THE INVENTION

The mobile work platform is a collapsible frame assembly that can support tools, supplies, and workers. The collapsible frame involves two distinct embodiments wherein a first embodiment involves a frame assembly that simply folds flat when not in use, and a second embodiment involves a rotating ladder assembly in conjunction with a frame assembly that can fold flat when not in use. Both embodiments include ladder rungs upon each side to enable climbing upon said device as well as removable scaffolds.

An object of the invention is to provide a mobile work platform that acts as a scaffold, ladder, tool and material carrying device.

A further object of the invention is to provide a mobile work platform that in a second embodiment involves a rotating ladder assembly that can rotate vertically to enable ladder run access from the front as well as the sides of the frame.

A further object of the mobile work platform is to provide a lightweight platform that can be easily carried.

A further object of the invention is to provide a mobile work platform that is simple in design, effective, easy-to use and install, easy to manufacture, and affordable.

These together with additional objects, features and advantages of the mobile work platform will be readily apparent to those of ordinary skill in the art upon reading the following detailed description of presently preferred, but nonetheless illustrative, embodiments of the mobile work platform when taken in conjunction with the accompanying drawings.

In this respect, before explaining the current embodiments of the mobile work platform in detail, it is to be understood that the mobile work platform is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mobile work platform.

It is therefore important that the claims be regarded as including such equivalent construction insofar as they do not depart from the spirit and scope of the mobile work platform. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
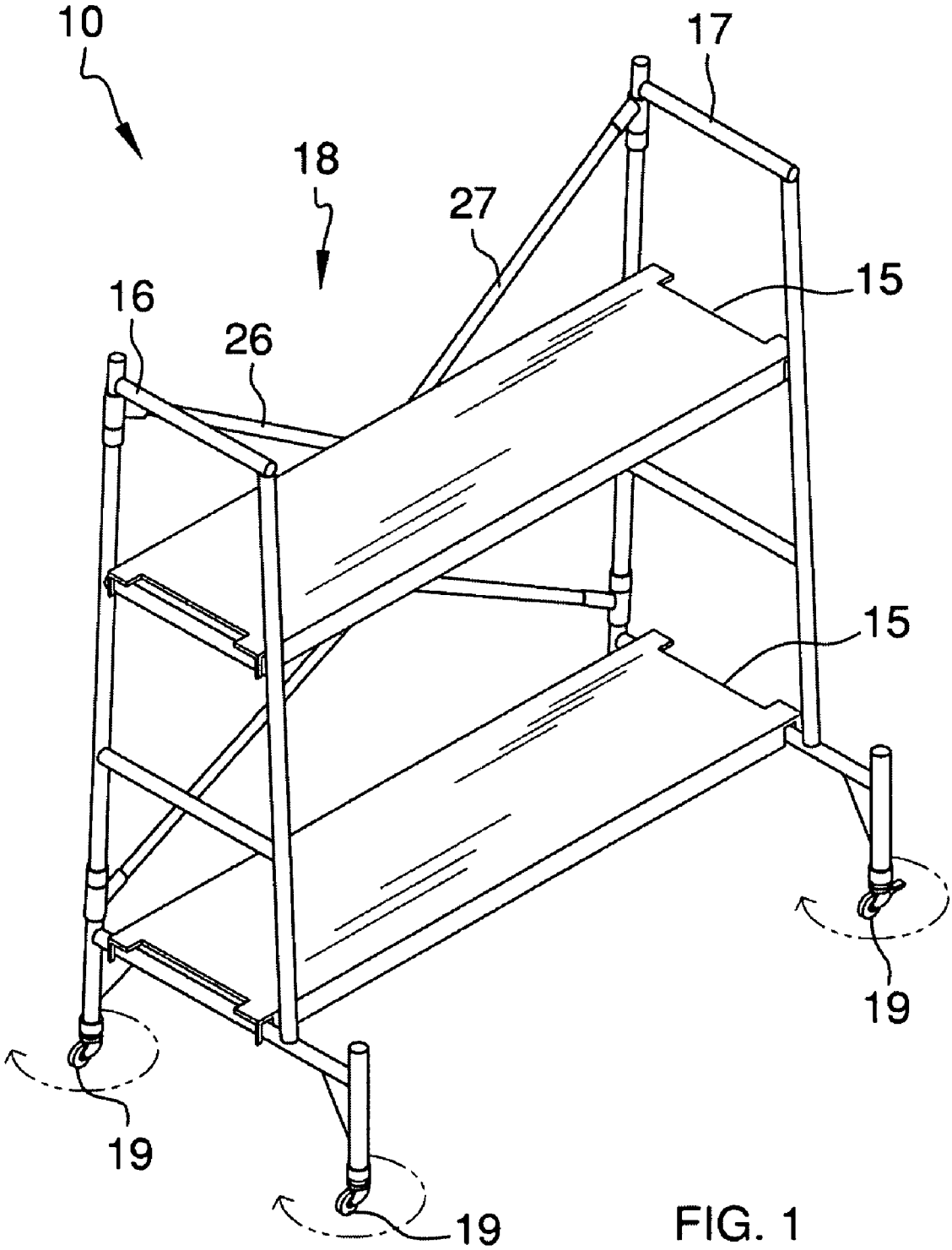
FIG. 1 illustrates an isometric view of a first embodiment of the mobile work platform wherein rotational arrows indicate movement of caster wheels.
Figure 2:
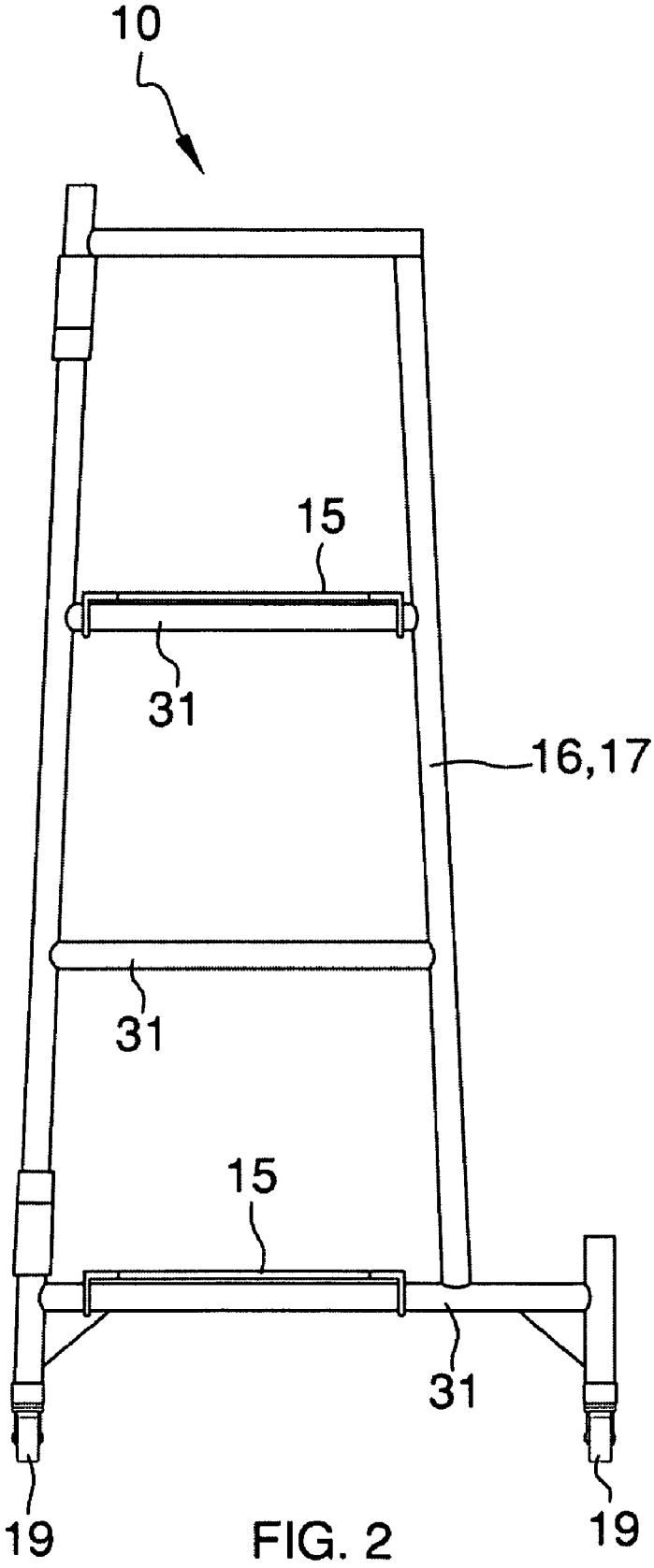
FIG. 2 illustrates a side view of the mobile work platform.

Detailed reference will now be made to the present invention, examples of which are illustrated in FIGS. 1-5. A first embodiment of a mobile work platform 10 (hereinafter first embodiment) comprises a plurality of removable shelves 15, a left "A" frame 16, a right "A" frame 17, a support frame 18, and a plurality of caster wheels 19.

The removable shelves 15 have hanging means 25 on each end of each removable shelve 15. The removable shelves are of lightweight construction, but capable of supporting heavy loads. The overall length of the removable shelves 15 shall be dictated by the length of the support frame 18.

Figure 3:
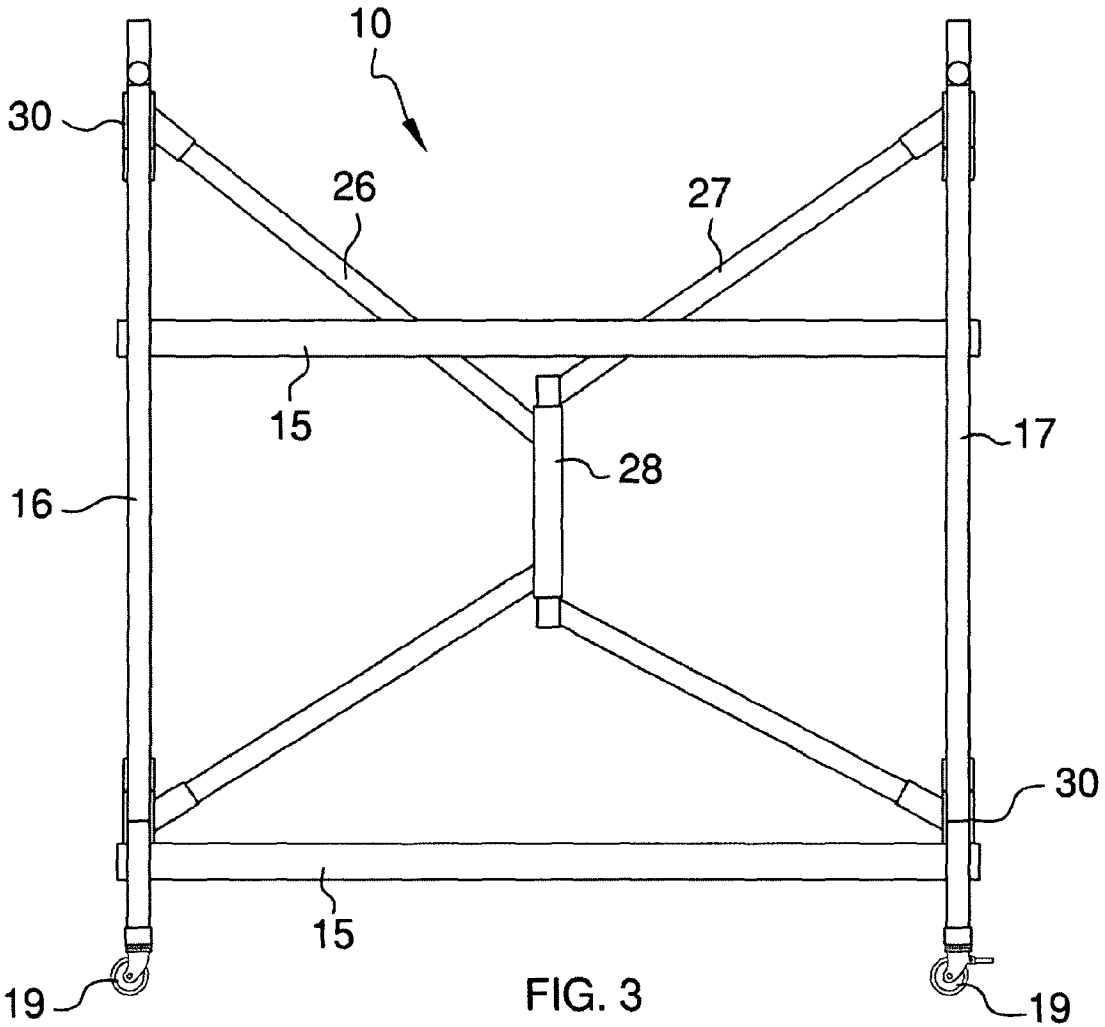
FIG. 3 illustrates a front view of the mobile work platform.
Figure 4:
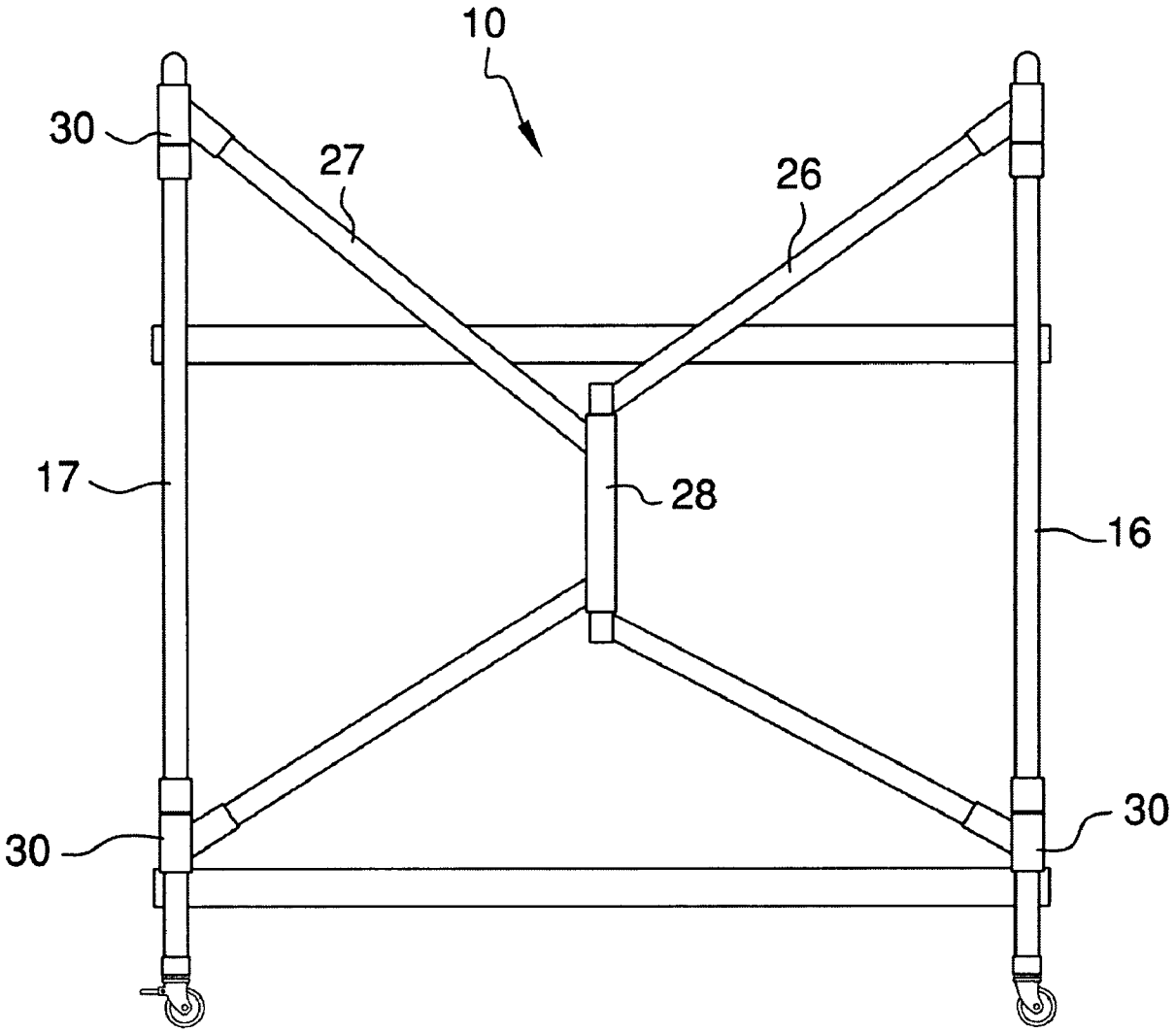
FIG. 4 illustrates a rear view of the mobile work platform.

The support frame 18 is made of lightweight, yet durable construction. The support frame 18 comprises a left half 26, and a right half 27. The left half 26 and the right half 27 are connected by a sleeve 28 along the middle region, as depicted in FIG. 3.

The left half 26 of the support frame 18 is connected along the top and bottom of the left "A" frame 16 by pivot points 30. The right half 27 is connected along the top and the bottom of the right "A" frame 17 by pivot points 30.

The left "A" frame 16 and the right "A" frame 17 each have a plurality of corresponding horizontal cross members 31 at a variety of heights. The horizontal cross members 31 provide the first embodiment 10 with a plurality of heights for placement of the removable shelves 15, as depicted in FIGS. 1-4

The left "A" frame 16 and the right "A" frame 17 each have a plurality of the caster wheels 19. The bottom of the left and right "A" frames 16 and 17, have an enlarged horizontal cross member 31, which provides more overall stability for the first embodiment 10.

Figure 5:
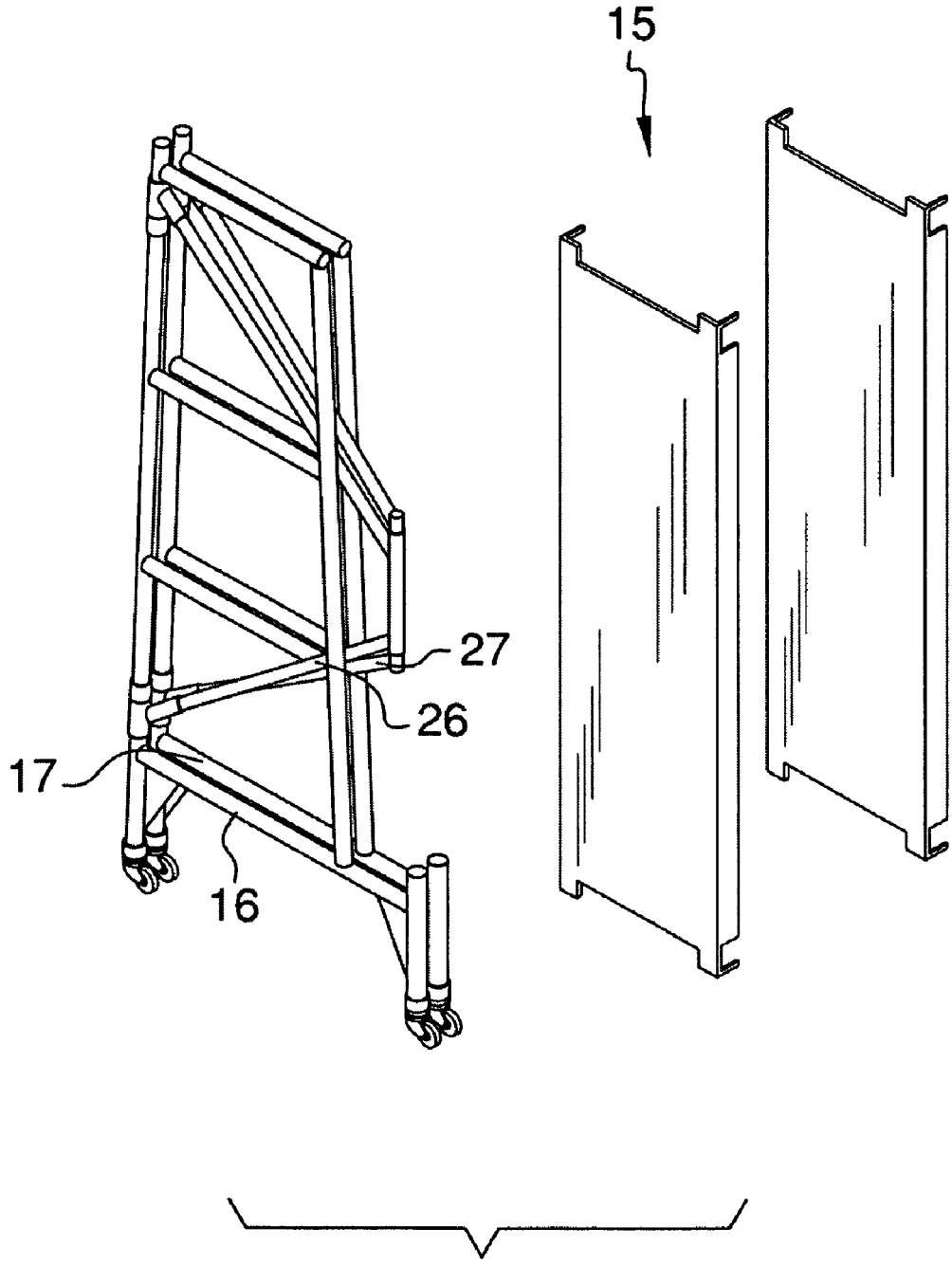
FIG. 5 illustrates the shelves removed, and the frame collapsed.
Figure 6:
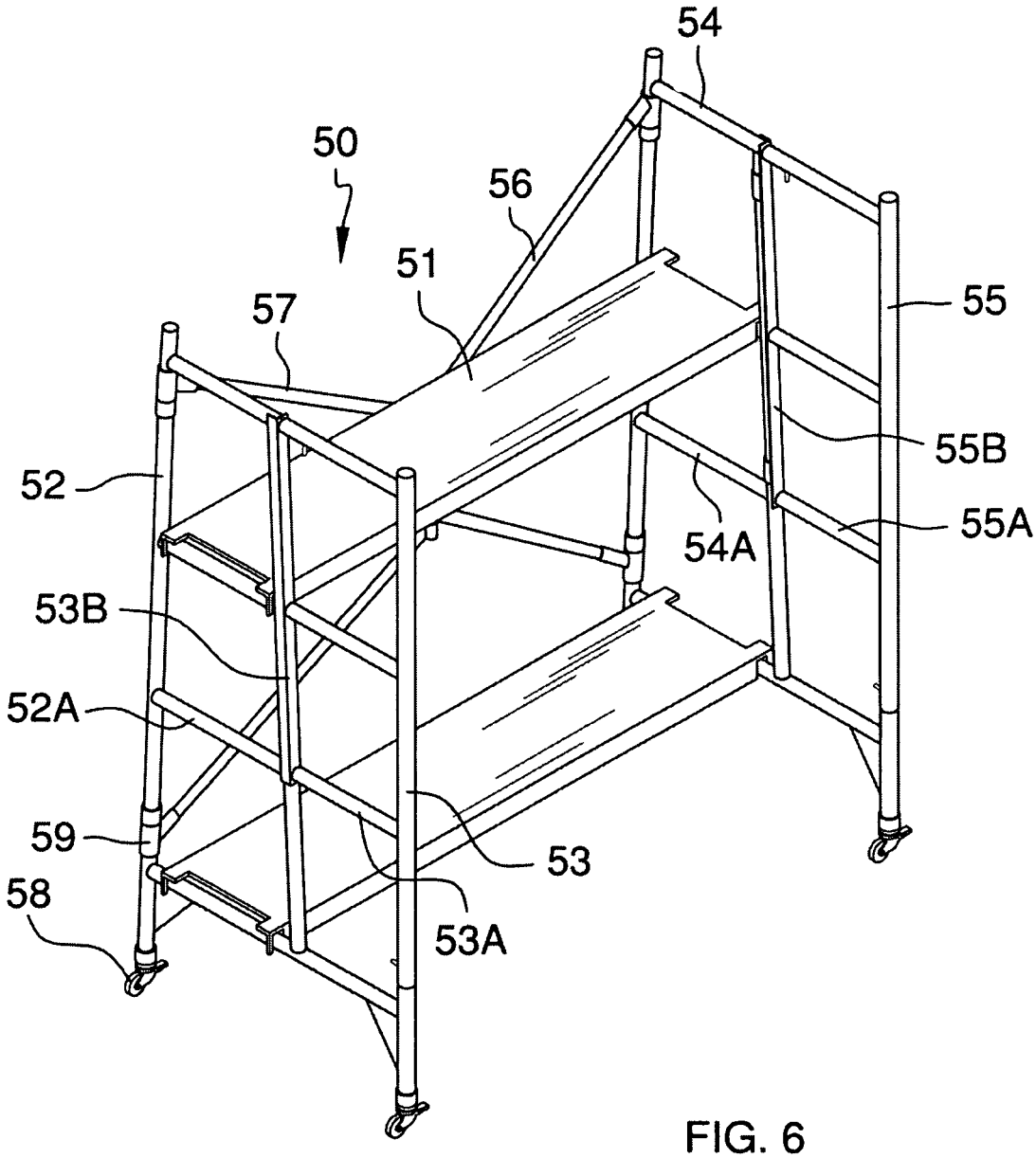
FIG. 6 illustrates an isometric view of the second embodiment with the rotating ladder assembly extended along each side of the frame.
Figure 7A:
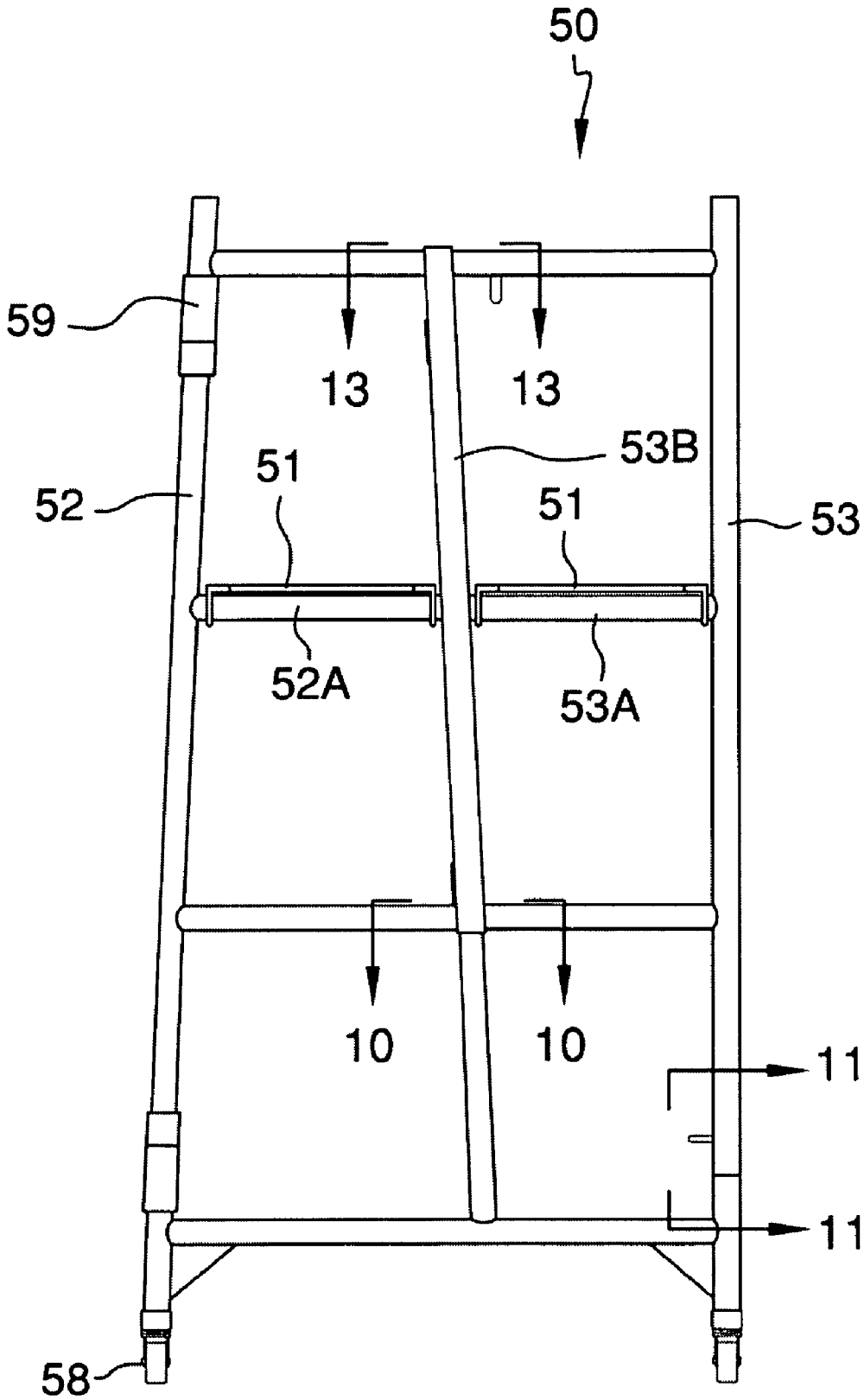
FIG. 7A illustrates a side view of the second embodiment.
Figure 7B:
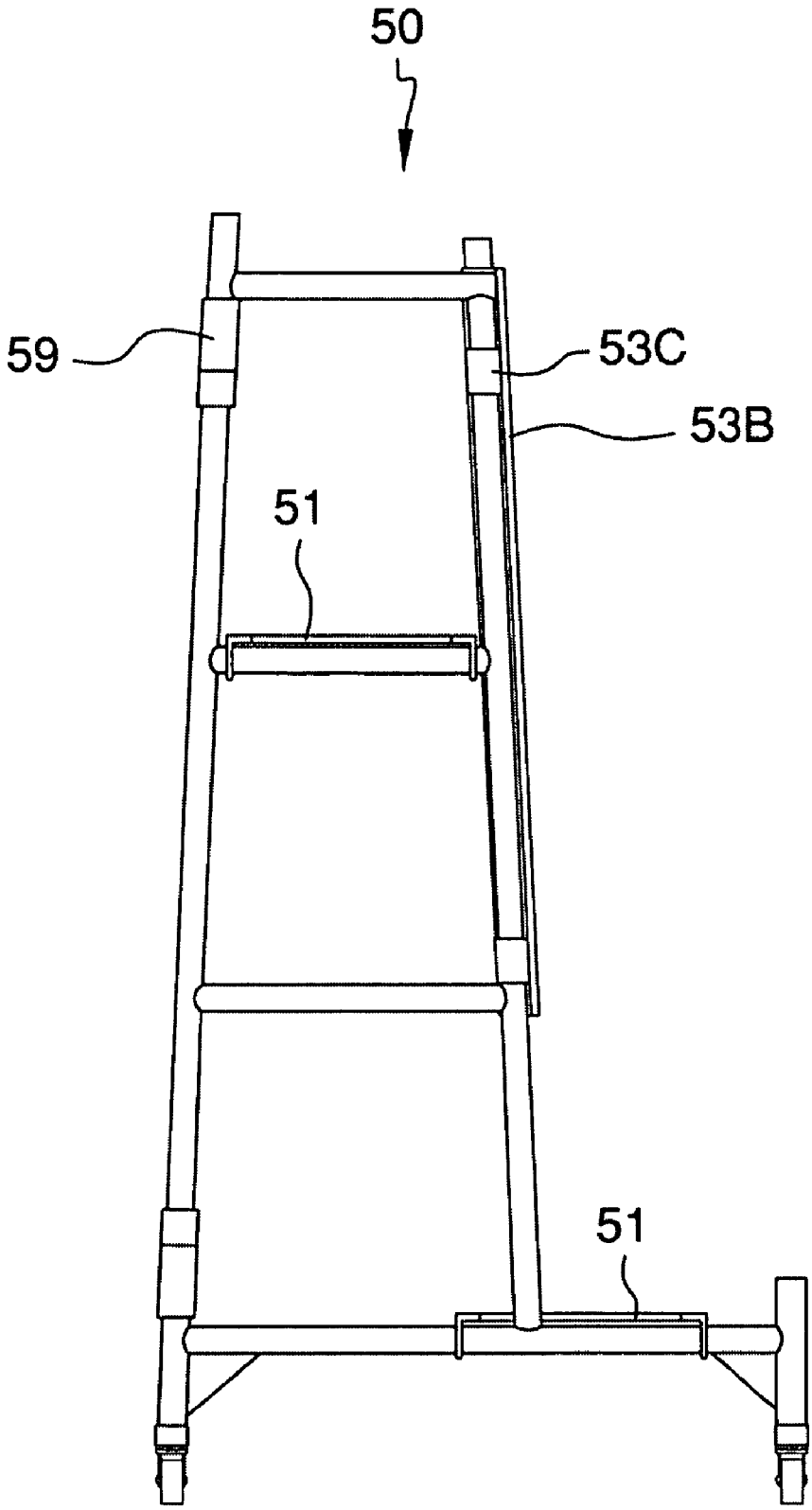
FIG. 7B illustrates a side view of the second embodiment with the rotating ladder assembly rotated about the front side of the frame.
Figure 8:
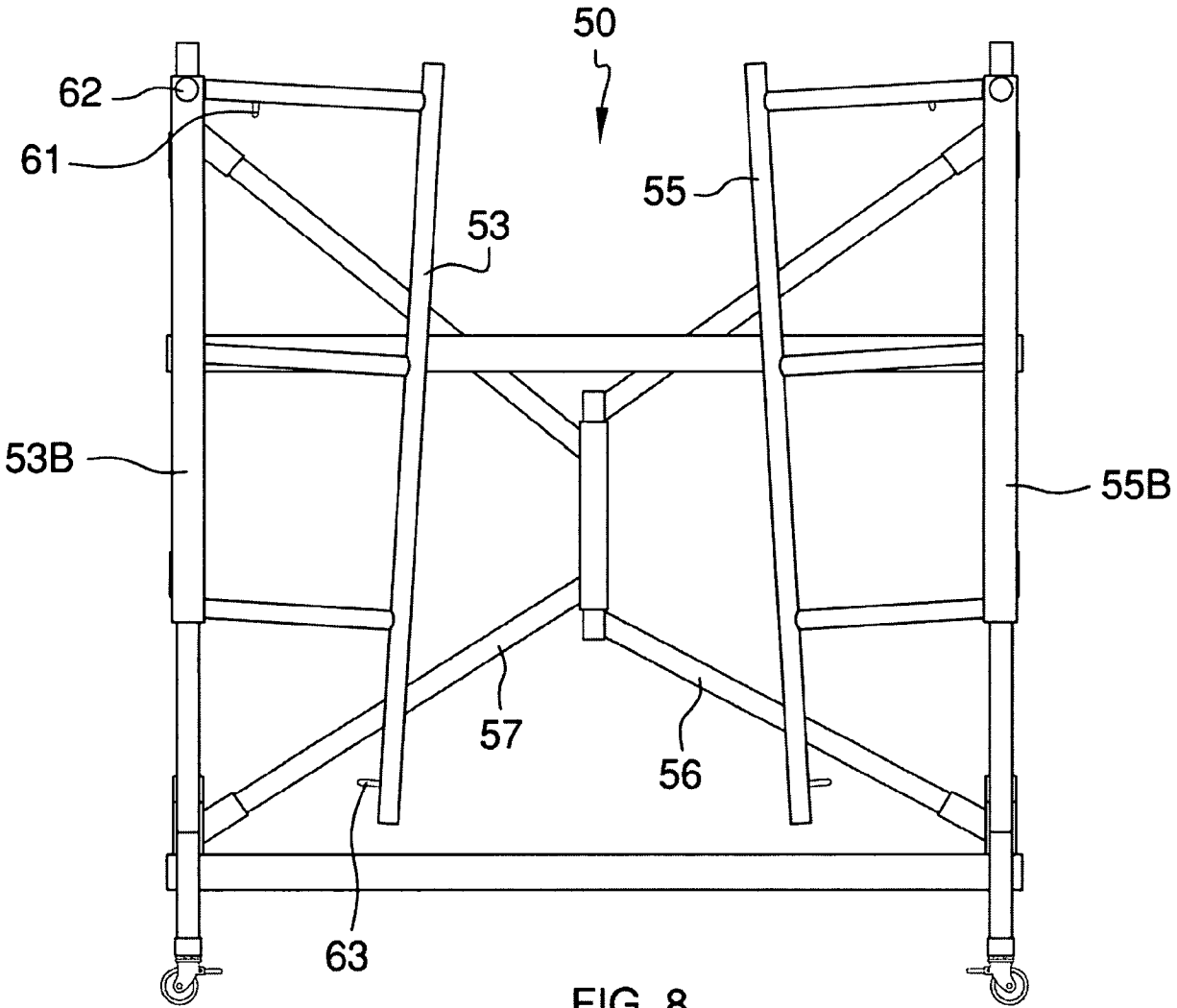
FIG. 8 illustrates a front view of the second embodiment with the rotating ladder assembly rotated about the front side of the frame.
Figure 9:
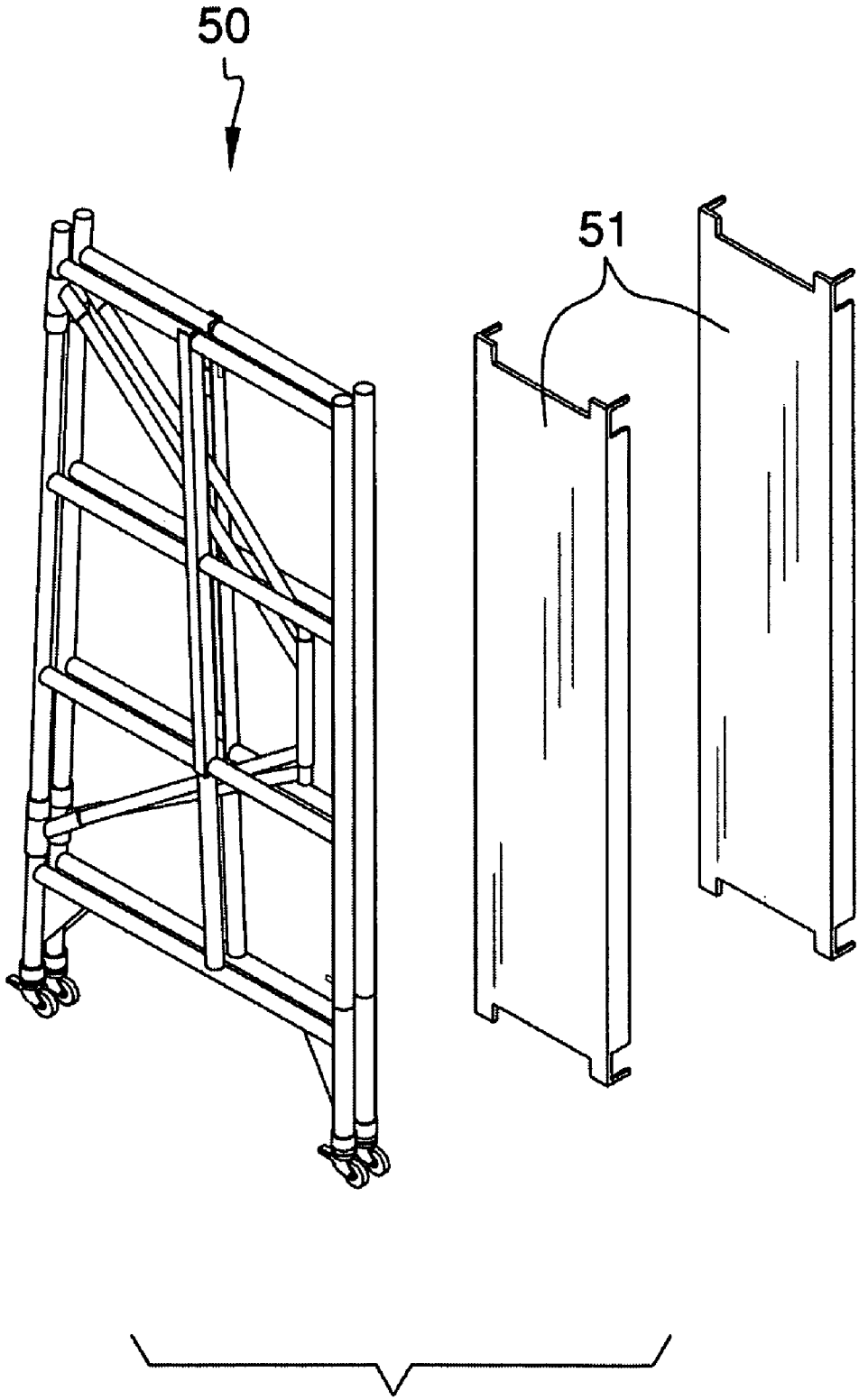
FIG. 9 illustrates the second embodiment with the frame collapsed and the shelves removed.
Figure 10:
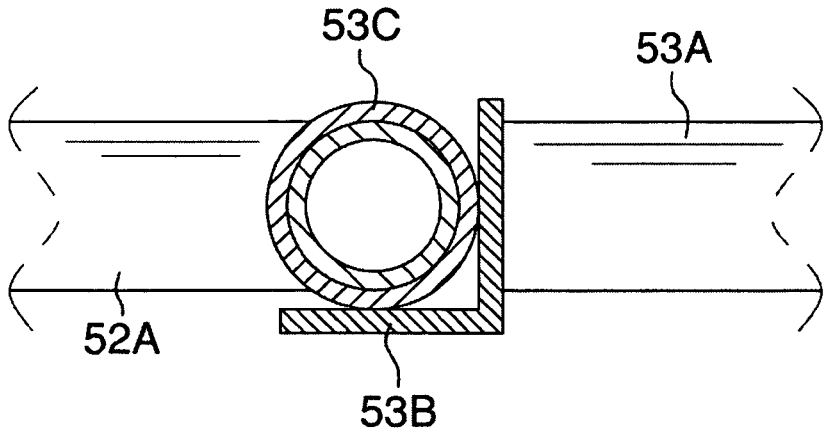
FIG. 10 illustrates a cross-sectional view of the second embodiment along line 10-10 in FIG. 7 further detailing the inter-relation of the rotating ladder assembly and the end frame.
Figure 11:
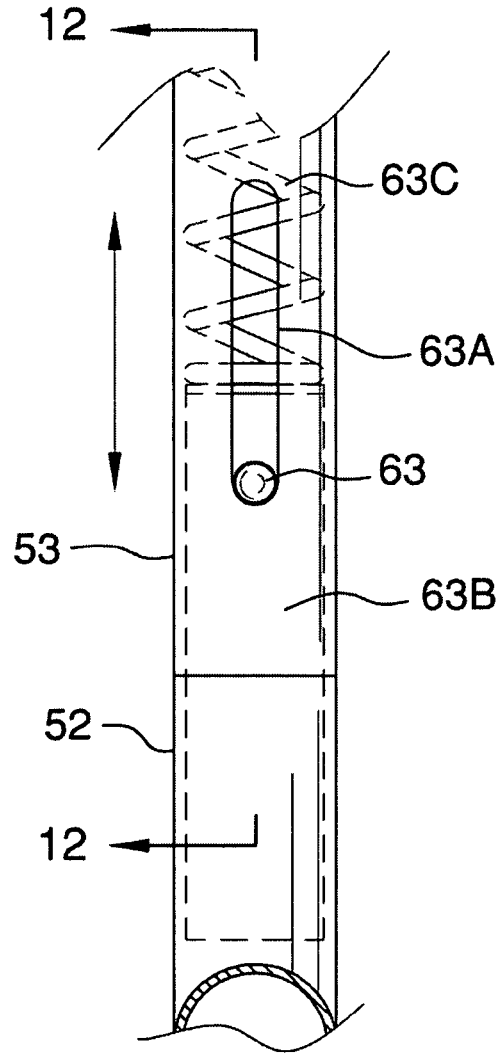
FIG. 11 illustrates a cross-sectional view of the second embodiment along line 11-11 in FIG. 7 further detailing the locking means of the rotating ladder assembly.
Figure 12:
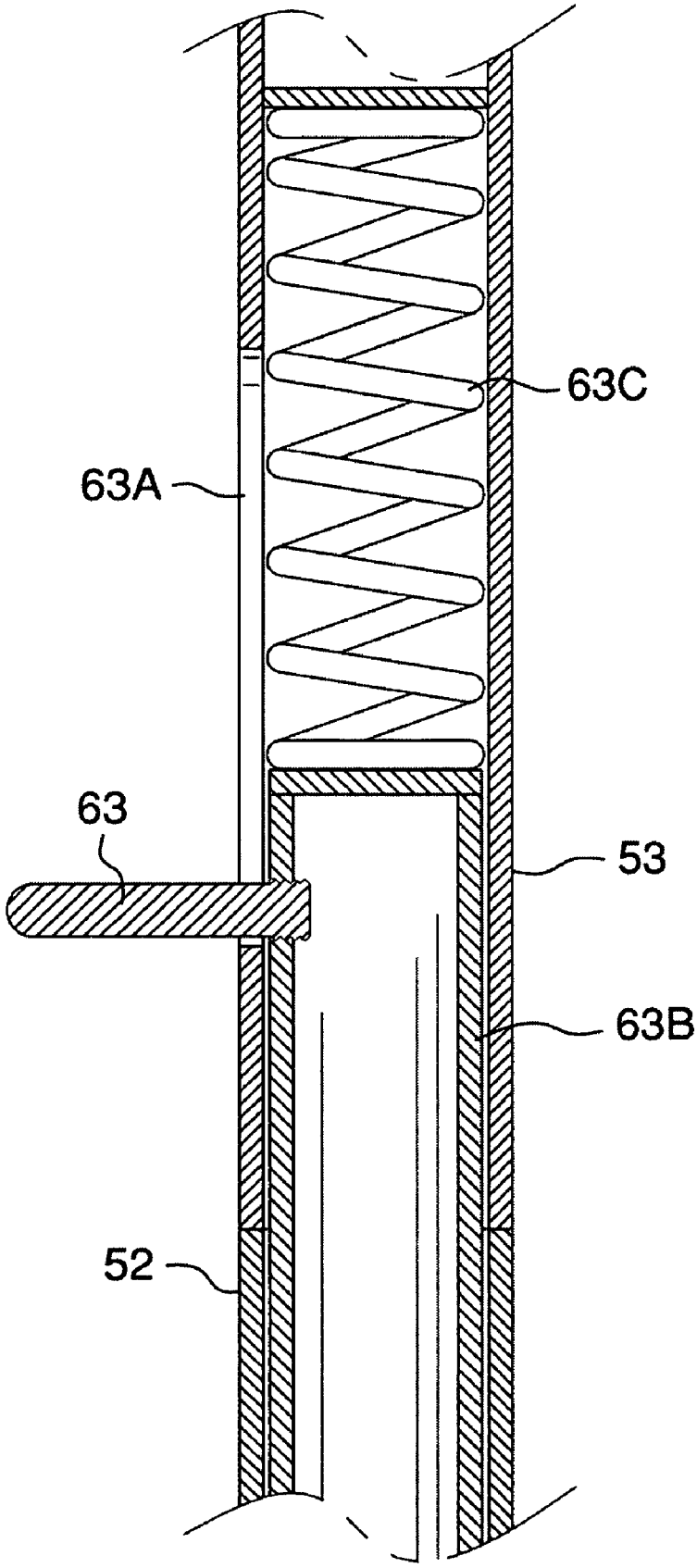
FIG. 12 illustrates a cross-sectional view of the second embodiment along line 12-12 in FIG. 11 further detailing the locking means at a right angle with respect to the detail in FIG. 11, and further illustrating the pin and track interaction.
Figure 13:
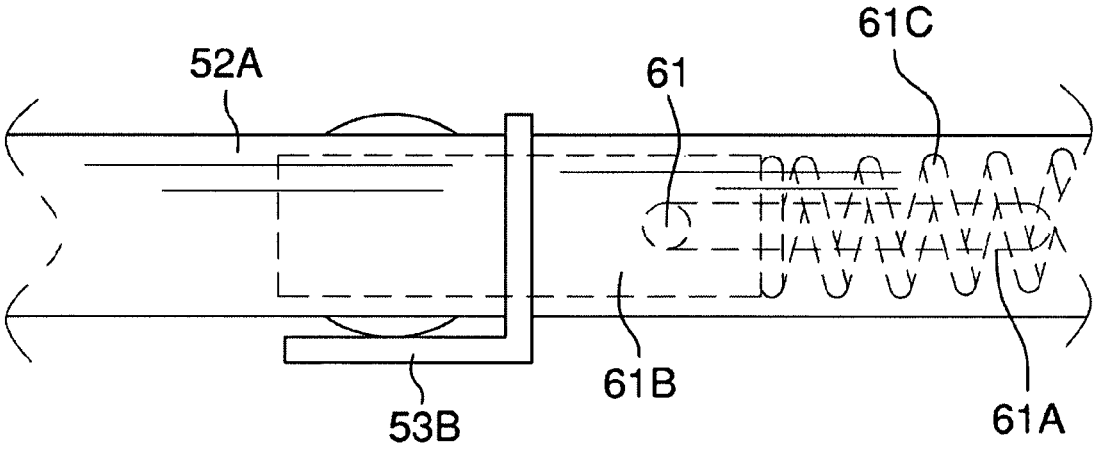
FIG. 13 illustrates a cross-sectional view of the second embodiment along line 13-13 in FIG. 7 further detailing the locking means along the top of the rotating ladder assembly.

When the first embodiment 10 is not in use, the removable shelves 15 are removed. Next, the left "A" frame 16 is folded flat with respect to the left half 26; the right "A" frame 17 is folded flat with respect to the right half 27. Next, the left half 26 and the right half 27 are folded flat with respect to each other, as depicted in FIG. 5.

The removable shelves 15, the left "A" frame 16, the right "A" frame 17, the left half 26, the right half 27, the sleeve 28, and the pivot points 30 are made from a lightweight material comprising a durable plastic, wood, or metal.

Referring now to FIGS. 6-13, a second embodiment 50 includes a plurality of shelves 51, a left "A" frame 52, a left rotating ladder 53, a right "A" frame 54, a right rotating ladder 55, a right support frame 56, a left support frame 57, a plurality of caster wheels 58, a plurality of pivot points 59, a pair of upper rotating ladder locking means 61, and a pair of lower rotating ladder locking means 63.

The plurality of shelves 51, the left "A" frame 52, the right "A" frame 54, the right support frame 56, the left support frame 57, the plurality of caster wheels 58, and the plurality of pivot points 59 all function in the same manner as the first embodiment 10.

The left rotating ladder 53 and the right rotating ladder 55 operate in the same manner, but in opposite orientations with one another. Angle irons 53B and 55B provide two functions for each rotating ladder, (i) to support hinges 53C and 55C in order to enable horizontal rotational movement of a ladder with respect to the "A" frame, and (ii) to enable the upper locking means an opening for securing the respective ladder in an aligned state with respect to the "A" frame.

The pair of lower rotating ladder locking means 63 further include a track 63A, a locking bar 63B, a spring 63C. The locking bar 63B is designed to enter the respective "A" frame and lock the rotating ladder 53 in an aligned state with respect to the "A" frame. The rotating ladder 53 can rotate about a front side of the second embodiment 50 by sliding the pin 63 along the track 63A until the locking bar 63B becomes disengaged with the "A" frame. Then, the rotating ladder 53 is rotated about the front of the second embodiment 50.

The upper rotating ladder locking means 61 includes a pin 61, a track 61A, a locking bar 61B, and a spring 61C. The pair of upper rotating ladder locking means 61 operates in the same manner as the lower rotating ladder locking means 63.

With respect to the above description, it is to be realized that the optimum dimensional relationship for the various components of the first embodiment 10 and the second embodiment 50, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the first embodiment 10 and the second embodiment 50.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobile work platform comprising:

a plurality of removable shelves including hanging means;

a support frame comprising a left half and a right half that pivot with respect to one another via a rotating connection and are thus capable of folding flat;

a left "A" frame and a right "A" frame each of which connects to the respective half, and can rotate flat with the left and right half, and wherein both the left "A"

frame and right "A" frame includes a plurality of horizontal cross-members that support the shelves via the hanging means;

a left rotating ladder and a right rotating ladder, wherein the respective ladder connects along a front edge of the respective "A" frame via a rotating connection, and of which the respective ladder can rotate from an aligned position with the respective "A" frame to aligned with a front edge of the removable shelves, and wherein locking means are used to secure the rotating ladder with respect to the corresponding "A" frame;

wherein the bottom horizontal cross-member is elongated so as to increase the overall stability of the mobile work platform;

wherein the locking means are further defined as lower rotating ladder locking means and upper rotating ladder locking means;

wherein the lower rotating ladder locking means and the upper rotating ladder locking means each includes a track, a locking bar, a spring;

wherein the locking bar enters the respective "A" frame and locks the rotating ladder in an aligned state with respect to the "A" frame;

wherein the rotating ladder can rotate about a front side of the mobile work platform by sliding the pin along the track until the locking bar becomes disengaged with the "A" frame.

2. The mobile work platform as described in claim 1 wherein both the left "A" frame and the right "A" frame each have a plurality of caster wheels mounted along the bottom.

3. The mobile work platform as described in claim 1 wherein both the left "A" frame and the right "A" frame each have a plurality of caster wheels mounted along the bottom, and wherein at least one caster wheel is a locking caster wheel.

4. The mobile work platform as described in claim 1 wherein the hanging means comprises a set of notched grooves near each end of the removable shelves in which each notched grooves sit on the horizontal cross members of the left "A" frame and the right "A" frame.

5. The mobile work platform as described in claim 1 wherein the rotating connection includes a sleeve located between the left half and the right half.

6. The mobile work platform as described in claim 1 wherein the minimum number of horizontal cross members on each left "A" frame and right "A" frame is 2.

7. The mobile work platform as described in claim 1 wherein the maximum number of horizontal cross members on each left "A" frame and right "A" frame is 6.

8. The mobile work platform as described in claim 1 wherein a sleeve, the pivot points, the left half, the right half, the left "A" frame, the right "A" frame are made of a lightweight material comprising a durable plastic, wood, metal.

9. A mobile work platform comprising:

a plurality of removable shelves including hanging means;

a support frame comprising a left half and a right half that pivot with respect to one another via a rotating connection and are thus capable of folding flat;

a left "A" frame and a right "A" frame each of which connects to the respective have, and can rotate flat with the left and right half, and wherein both, the left "A" frame and right "A" frame includes a plurality of horizontal cross-members that support the shelves via the hanging means;

a left rotating ladder and a right rotating ladder, wherein the respective ladder connects along a front edge of the respective "A" frame via a rotating connection, and of which the respective ladder can rotate from an aligned position with the respective "A" frame to aligned with a front edge of the removable shelves, and wherein locking means are used to secure the rotating ladder with respect to the corresponding "A" frame;

wherein both the left "A" frame and the right "A" frame each have a plurality of caster wheels mounted along the bottom;

wherein the bottom horizontal cross-member is elongated so as to increase the overall stability of the mobile work platform;

wherein the locking means are further defined as lower rotating ladder locking means and upper rotating ladder locking means;

wherein the lower rotating ladder locking means and the upper rotating ladder locking means each includes a track, a locking bar, a spring;

wherein the locking bar enters the respective "A" frame and locks the rotating ladder in an aligned state with respect to the "A" frame;

wherein the rotating ladder can rotate about a front side of the mobile work platform by sliding the pin along the track until the locking bar becomes disengaged with the "A" frame.

10. The mobile work platform as described in claim 9 wherein both the left "A" frame and the right "A" frame each have a plurality of caster wheels mounted along the bottom, and wherein at least one caster wheel is a locking caster wheel.

11. The mobile work platform as described in claim 9 wherein the hanging means comprises a set of notched grooves near each end of the removable shelves in which each notched grooves sit on the horizontal cross members of the left "A" frame and the right "A" frame.

12. The mobile work platform as described in claim 9 wherein the rotating connection includes a sleeve.

13. The mobile work platform as described in claim 9 wherein the minimum number of horizontal cross members on each left "A" frame and right "A" frame, as, well as left rotating ladder and right rotating ladder, is 2.

14. The mobile work platform as described in claim 9 wherein the maximum number of horizontal cross members on each left "A" frame and right "A" frame, as well as left rotating ladder and right rotating ladder, is 6.

15. The mobile work platform as described in claim 9 wherein a sleeve, the pivot points, the left half, the right half, the left "A" frame, the right "A" frame, the left rotating ladder, and the right rotating ladder are made of a lightweight material comprising a durable plastic, wood, metal.

* * * * *